United States Patent [19]

Ohminato

[11] Patent Number: 4,693,625

[45] Date of Patent: Sep. 15, 1987

[54] BINDER ASSEMBLIES

[75] Inventor: Kiyoshi Ohminato, Tokyo, Japan

[73] Assignee: King Jim Co., Ltd., Tokyo, Japan

[21] Appl. No.: 830,122

[22] Filed: Feb. 18, 1986

[30] Foreign Application Priority Data

Jun. 27, 1985 [JP] Japan ..... 60-98923

[51] Int. Cl.[4] ..... B42F 3/04

[52] U.S. Cl. ..... 402/27; 402/26; 402/48; 402/49

[58] Field of Search ..... 402/45, 46, 48, 49, 402/50, 51, 52, 54, 55, 56, 25, 26, 27

[56] References Cited

U.S. PATENT DOCUMENTS

| | | | |
|---|---|---|---|
| 1,701,090 | 2/1929 | Wigginton | 402/26 |
| 2,024,461 | 12/1935 | Lotter | 402/26 |
| 2,162,594 | 6/1939 | Vaughan | 402/48 |
| 2,590,928 | 4/1952 | Broadhurst | 402/26 |
| 2,915,068 | 12/1959 | Miyamoto | 402/48 |
| 3,879,142 | 4/1975 | Takimoto | 402/25 |
| 4,056,326 | 11/1977 | Crawford | 402/30 |
| 4,168,920 | 9/1979 | Ohminato | 402/46 |

FOREIGN PATENT DOCUMENTS

| | | | |
|---|---|---|---|
| 561813 | 10/1932 | Fed. Rep. of Germany | 402/46 |
| 2107125 | 8/1978 | Fed. Rep. of Germany | 402/48 |

*Primary Examiner*—Paul A. Bell

*Attorney, Agent, or Firm*—Wegner & Bretschneider

[57] ABSTRACT

A binder assembly which is openable in the opposite direction, wherein it includes a turnable member having binding rods and a turnable member having binding pipes adapted to receive said binding rods, said turnable members being separately and detachably provided on both sides of a bottom plate fixed to a back cover of a file in such a manner that they are turnable with respect to said bottom plate.

7 Claims, 6 Drawing Figures

BINDER ASSEMBLIES

FIELD OF THE INVENTION

The present invention relates to a binder assembly having side plates which are openable or rotatable in the opposite directions relative to each other.

BACKGROUND OF THE INVENTION

The prior art turnable type binder assembly includes one side plate that is fixed in place and the other side plate that is turnable, and is openable in one direction alone. However, it is desired to open that binder in the opposite direction depending upon the state of papers.

Object of the Invention

A primary object of the present invention is, therefore, to provide a novel binder assembly having side plates which are openable or rotatable in the opposite directions relative to each other, and is of highly practical value.

Other objects and features provided by the present invention will become apparent from the ensuing detailed description of the invention's presently preferred embodiment with reference to the accompanying drawings, which are given for the purpose of illustration alone.

DETAILED DESCRIPTION OF THE PREFERRED EMBODIMENT

Figure 1:
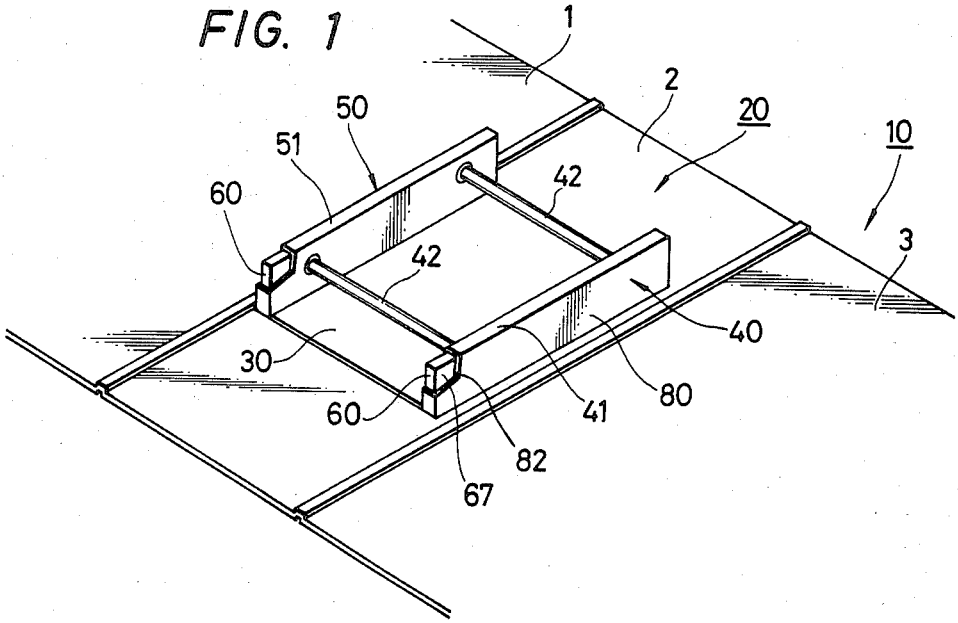
FIG. 1 is a perspective view showing the binder assembly according to the present invention.

Referring now to FIG. 1, there is generally shown a doublebinding binder assembly according to the present invention, wherein reference numeral 1 denotes a left cover, 2 a back cover and 3 indicates a right cover. In the binder assembly generally shown at 10 a bottom plate portion 30 is fixedly provided to the back cover 2. Turnable members 40 and 50 are pivotally provided on both sides of the bottom plate portion 30, and are designed to be attachable to or detachable from the bottom plate portion 30. As wil be described later, provision is made of a side plate 41, binding pipes 42, a keep plate 80, a notch 82, a sliding plate 60 and a side plate 51. The side plate 51 is provided with other binding rods 52, which are not exposed to view, since they are inserted through the first binding pipes 42.

Figure 2:
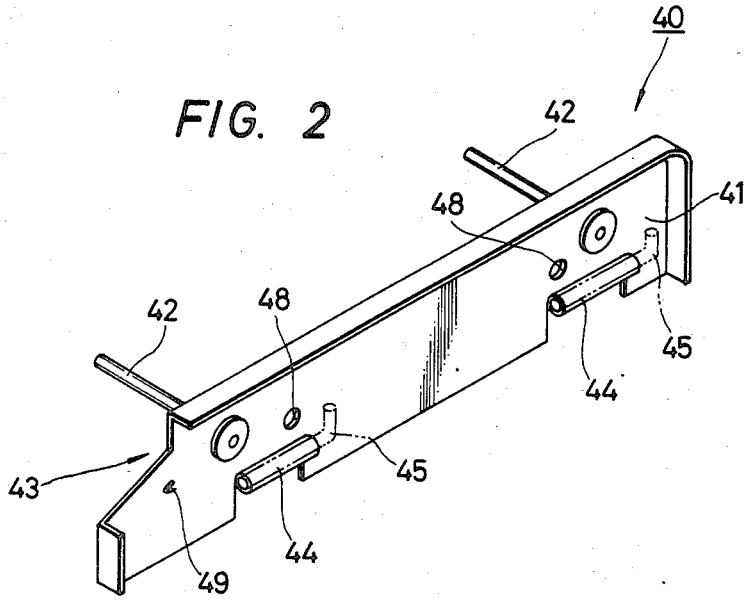
FIG. 2 is a perspective view of the turnable unit.

In FIG. 2, the side plate 41 for the turnable member 40 is illustrated. Reference numeral 42 stands for the binding pipes, as already mentioned. A notch, lower rounded and hollow portions and rivet holes are indicated at 43, 44 and 48, respectively. The rivet holes 48 and 48 are provided for locking the keep plate 80 in place, as will be explained later. As indicated by a two-dotted line, an engaging rod 45 is slidably inserted into the rounded and hollow portion 44.

Figure 3:
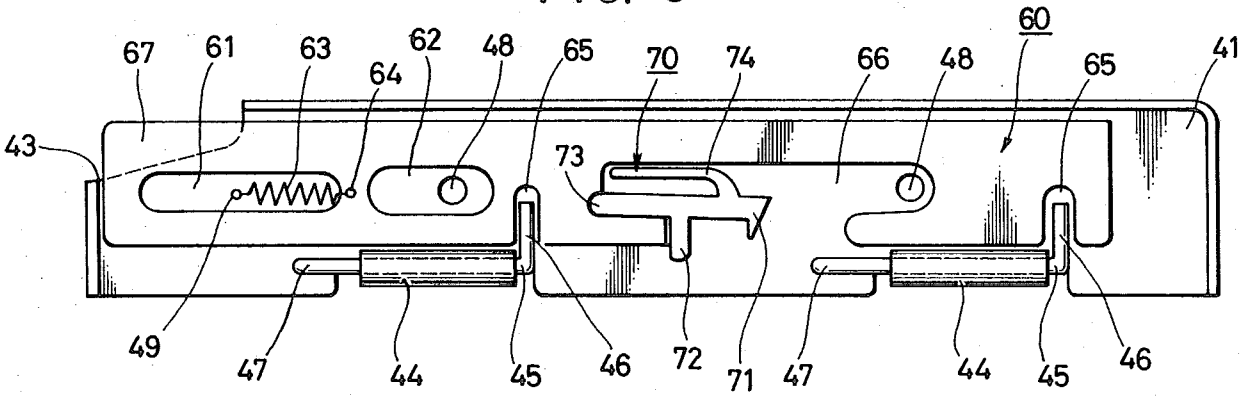
FIG. 3 is a view illustrating a combination of the side plate with sliding plate.

FIG. 3 shows the sliding plate 60 inserted within the side plate 41. The sliding plate 60 is formed of a synthetic resin material or the like, and includes therein elongated slots 61 and 62 and a void 66. Within the slot 61 is a spring 63, which is hooked at one end on a stop 49 of the side plate 41 and at the other end on a spring hook 64 provided on the sliding plate. In this manner, the spring 63 pulls the sliding plate 60 in the lefthand direction. A locking member 70 is pivotally supported at 73, and is constantly pressed down by an elastic rod 74. The locking member 70 is formed of a synthetic resin such as polycarbonate, and includes a locking catch 71 and a keep plate 72 in addition to the elastic rod 74.

Figure 4:
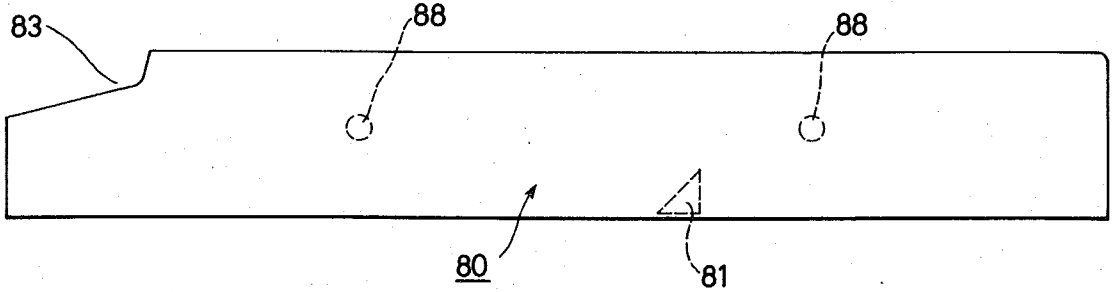
FIG. 4 is a view showing of the keep plate.

The engaging rod 45 is inserted through the rounded portion 44 of the side plate 41. The engaging rod 45 is in the L-shaped form, which includes an upright portion 46 designed to be inserted into a slit 65 in the sliding member 60 and to be slidable with the sliding member 60. The keep plate 80 is more clearly shown in FIG. 4, and includes a locking member 81 attached to the rear side thereof. The keep plate 80 of FIG. 4 is fixed in place with its rivet holes 88 being in alignment with the rivet holes 48 in sliding member 60 in a state as shown in FIG. 3. In FIG. 4, reference numeral 83 is a notch in coincidence with the notch 43 in the side plate 41, wherein the corner portion of the sliding plate 60 is exposed to view, as illustrated in FIG. 1.

Figure 5:
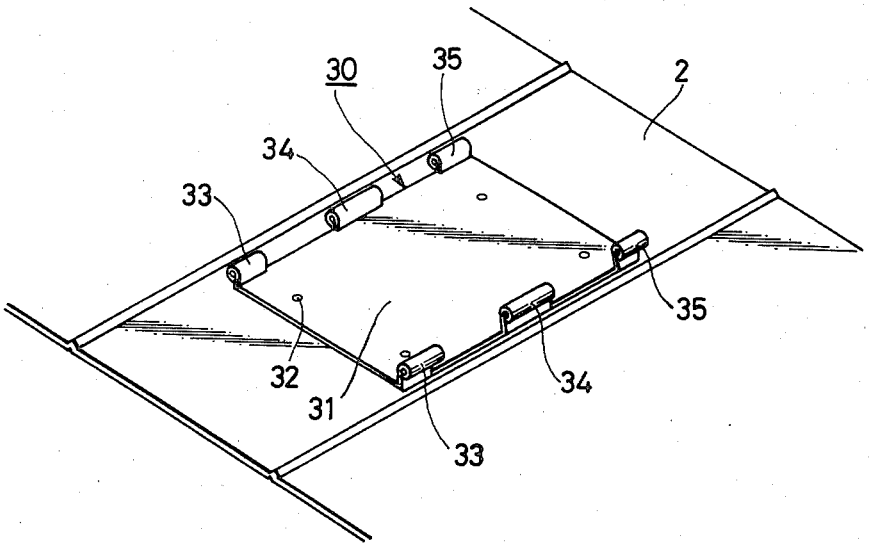
FIG. 5 is a perspective view showing the bottom plate alone.

The bottom plate member 30 is more clearly shown in FIG. 5 with its bottom plate 31 being fixed to the back cover 2. Reference numeral 32 stands for fixing rivet holes. On both sides of the bottom plate there are provided rounded and hollow portions 33, 34 and 35 at the symmetrical positions.

Figure 6:
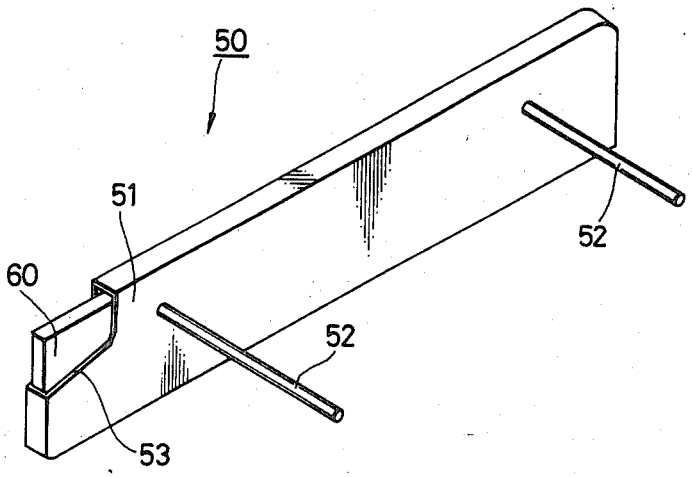
FIG. 6 is a perspective view illustrating another turnable unit.

FIG. 6 illustrates the turnable member 50 positioned in opposition to the turnable member 40. Binding rods 52 are attached to the side plate 51. The sliding plate 60, as shown in FIG. 3, is positioned on the farther side of the sliding plate 51 in FIG. 6, with its corner portion 53 being exposed to view in the notch 53. The turnable members 40 and 50 are opposite in their direction, but are all the same in the structure. To put it in another way, the turnable members of the same structure are disposed back to back, or the binding pipe of the turnable member 40 faces that of the turnable member 50.

In use, opening of one turnable member 60 is effected in the following manner. Referring to FIGS. 1 and 3–5, a push is given to the corner portion 67 of the sliding plate 60 exposed to between the notches 43 and 83 to cause sliding movement of the sliding plate 60 against the action of the spring 63 in the righthand direction in FIG. 3. Thereupon, the upright portion 46 of the engaging rod 46, now inserted into the slit 65 in the sliding plate 60, slides with the sliding plate 60 through the rounded portion 44 in the righthand direction, until the end 47 of the horizontal portion disengages the rounded portions 33 and 34 of the bottom plate 31. Since the turnable member 40 then becomes turnable, it is possible to turn that member 40 around the engaging rod 45 of the other turnable member 50 in the counterclockwise direction in FIG. 1 for disengagement of the binging rods 52 from the binding pipes 42.

When the sliding plate 50 slides in the righthand direction, the right-end locking pawl or catch 71 of the locking member 70 turns in the counterclockwise direction against the action of the elastic rod 74, and overrides the engaging projection 81 on the back side of the keep plate 80 for engagement therewith, so that the sliding plate 60 is locked in place at its righthand position.

Referring then to the fitting of the turnable member 40 onto the bottom plate portion 30, the former is positioned onto the latter after papers have been kept in file. Thereupon, the keep rod 72 of the locking member 70 abuts against the middle rounded portion 34 of the bottom plate 31, which is positioned on the righthand side, so that the locking member 70 is pressed and turns in the counterclockwise direction, whereby the locking catch 71 disengages the engaging projection 81. Then, the sliding plate 60 is pulled as a whole by the spring 63, and returns in the lefthand direction. Finally, the end of the horizontal portion of the engaging rod 45 enters the rounded portions 33 and 34 for engagement, whereupon the binder assembly is closed.

The same operations are repeated to turn the opposite turnable member 50 for removal of the binding rods 52 from the binding pipes 42.

As explained in detail above, the binder assembly of the present invention is of a relatively simple construction, can be opened in either one of the opposite directions, and is thus of highly practical value.

While the invention has been particularly shown and described in reference to preferred embodiments thereof, it will be understood by those skilled in the art that changes in form and details may be made without departing from the spirit and scope of the invention.

What is claimed is:

1. A binder assembly, comprising:

a first rotatable member; and a second rotatable member, wherein said first rotatable member comprises at least one binding rod and said second rotatable member comprises at least one binding pipe adapted to receive said at least one binding rod, and wherein said first and second rotatable members are separately and detachably provided on both sides of a bottom plate fixed to a back of a file in such a manner that said first and second rotatable members are turnable with respect to said bottom plate.

2. The binder assembly as in claim 1, wherein each of said first and second rotatable members further comprises: (a) a slidable plate housed therein secured by a spring; and (b) a locking member which moves along with said slidable plate.

3. The binder assembly as in claim 2, wherein each of said first and second rotatable members further comprises an engaging rod which slides along a first hollow portion coupled to the bottom portion of said rotatable member.

4. The binder assembly as in claim 3, wherein said engaging rod of each of said first and second rotatable members engages to or disengages from at least one second hollow portion coupled to a side of said bottom plate.

5. The binder assembly as in claim 4, wherein said locking member rotatably locks onto an engaging projection attached to an inner side portion of each of said first and second rotatable members.

6. The binder assembly as in claim 5, wherein a corner portion of said slidable plate is exposed beyond said rotatable plate suitable for being pushed towards the inner portion of said rotatable plate for engaging or disengaging said engaging rod from said rotatable plate.

7. The binder assembly as in claim 5, wherein a corner portion of said slidable plate is exposed beyond said rotatable plate suitable for being pushed towards the inner portion of said rotatable plate for engaging or disengaging said locking member with said engaging projection.

* * * * *